United States Patent [19]

Sims, Jr.

[11] Patent Number: 4,963,055

[45] Date of Patent: Oct. 16, 1990

[54] PORTABLE REINFORCED ASPHALT TILE

[76] Inventor: Earnest Sims, Jr., 46 Brunswick Rd., Depew, N.Y. 14043

[21] Appl. No.: 387,355

[22] Filed: Jul. 31, 1989

[51] Int. Cl.[5] ..... E01C 11/16

[52] U.S. Cl. ..... 404/41; 404/42; 404/45

[58] Field of Search ..... 404/36, 41, 42, 45; 52/338, 390, 612; 428/40, 489

[56] References Cited

U.S. PATENT DOCUMENTS

| | | | |
|---|---|---|---|
| 652,995 | 7/1900 | Calkins | 52/592 |
| 1,300,591 | 4/1919 | Ebinger | 404/42 X |
| 3,534,668 | 7/1968 | Scheincha | 404/45 |
| 3,568,579 | 3/1971 | Hoed et al. | 94/7 |
| 3,601,015 | 8/1971 | Killstofte | 94/8 |
| 3,859,000 | 1/1975 | Webster | 404/41 |
| 4,168,924 | 9/1979 | Draper et al. | 404/45 X |
| 4,531,857 | 8/1985 | Bettigole | 404/44 |
| 4,684,288 | 8/1987 | Chapa | 404/45 X |

FOREIGN PATENT DOCUMENTS

| | | |
|---|---|---|
| 821549 | 12/1937 | France . |
| 383848 | 12/1932 | United Kingdom . |
| 386142 | 2/1933 | United Kingdom . |

OTHER PUBLICATIONS

The Exciting World of Concrete Patios.

*Primary Examiner*—William P. Neuder

[57] ABSTRACT

A portable, prefabricated, reinforced asphalt composition paving tile having a thickness from about one-half to about two and one-half inches is disclosed having upper surface and lower surface interlocking extensions. The tile is particularly suitable for the convenient installation of pavement on small surface areas where heavy construction equipment would be difficult to use.

15 Claims, 1 Drawing Sheet

PORTABLE REINFORCED ASPHALT TILE

The present invention relates to portable reinforced asphalt tiles structured to interlock for convenient installation on generally flat surfaces in the construction and repair of sidewalks, driveways and the like.

BACKGROUND OF THE INVENTION

Construction involving the use of asphalt paving material and the like has been widely practiced for decades, and though much effort has been expended on the development of new and better compositions of the materials little has been done to improve the basic methods of installation. Generally, the art of paving with asphalt materials has comprised the spreading of bulk loose asphalt compositions on the surface to be covered, in a continuous layer, and thereafter compressing the so spread material with a heavy roller or similar device. Such method of application has proved successful for many applications, particularly when the area to be paved is large and assessable to the use of large, bulky machinery.

Problems arise however when the area to be paved is small such that the typically large equipment required cannot access the area or when the cost of using such equipment is not economically feasible. Thus, the individual who has a small paving project to complete or for a variety of reasons would like to do the project without the complications of using the typical paving equipment of the art is usually left to using alternate materials or to inadequate means of installing the loose, bulk asphalt material as typically supplied in the industry.

SUMMARY OF THE INVENTION

The present invention provides a portable, prefabricated, fabricated reinforced asphalt tile, with interlocking surfaces faces particularly suitable for convenient paving of surfaces. The invention comprises polygonal asphalt tiles of thickness varying from about one-half inch to about two and one-half inches, having intimately enmeshed at about the middle of the thickness thereof and throughout its length and breadth, a rigid, net like, support structure. Each of the polygonal tiles have extending from its sides an upper flat surface interlocking means or a lower flat surface interlocking means. Rectangular tiles of the invention have extending from two adjacent sides an upper flat surface interlocking means, and from the other two adjacent sides a lower flat surface interlocking means. Triangular tiles of the invention have an upper flat surface interlocking means extending from two adjacent sides and a lower flat surface interlocking means extending from the remaining side. The polygonal tiles have abrasion resistant finished surfaces on both sides of their thickness and are invertable.

Typically identical polygonal tiles are used when paving an area. Thus, for example, to pave a generally rectangular area the tiles used will generally be identical rectangular tiles and they will be interlocked through the upper surface/lower surface extending interlocking means. At the edges, or at rounded corners, the tiles are intended to be trimmed to remove the upper surface/-lower surface interlocking means or to round off corners or conform the paving to a curve or the like.

Where the area to be paved is circular or triangular, the asphalt tiles will be triangular with the interlocking upper surfaces/lower surfaces appropriately interconnected.

Upon completion of the assembly of the interlocking polygons, it is intended that the asphalt tiles be at least minimally compacted together at the joining of the interlocking upper surfaces/lower surfaces. It is also intended that adhesion means be optionally applied to one or both of the upper/lower interlocking surfaces to provide additional assurance of the integrity of the completed, paved area.

Other details, uses and advantages of this invention will become apparent in the following description of the exemplary embodiments of the invention.

DETAILED DESCRIPTION OF THE INVENTION

Figure 1:
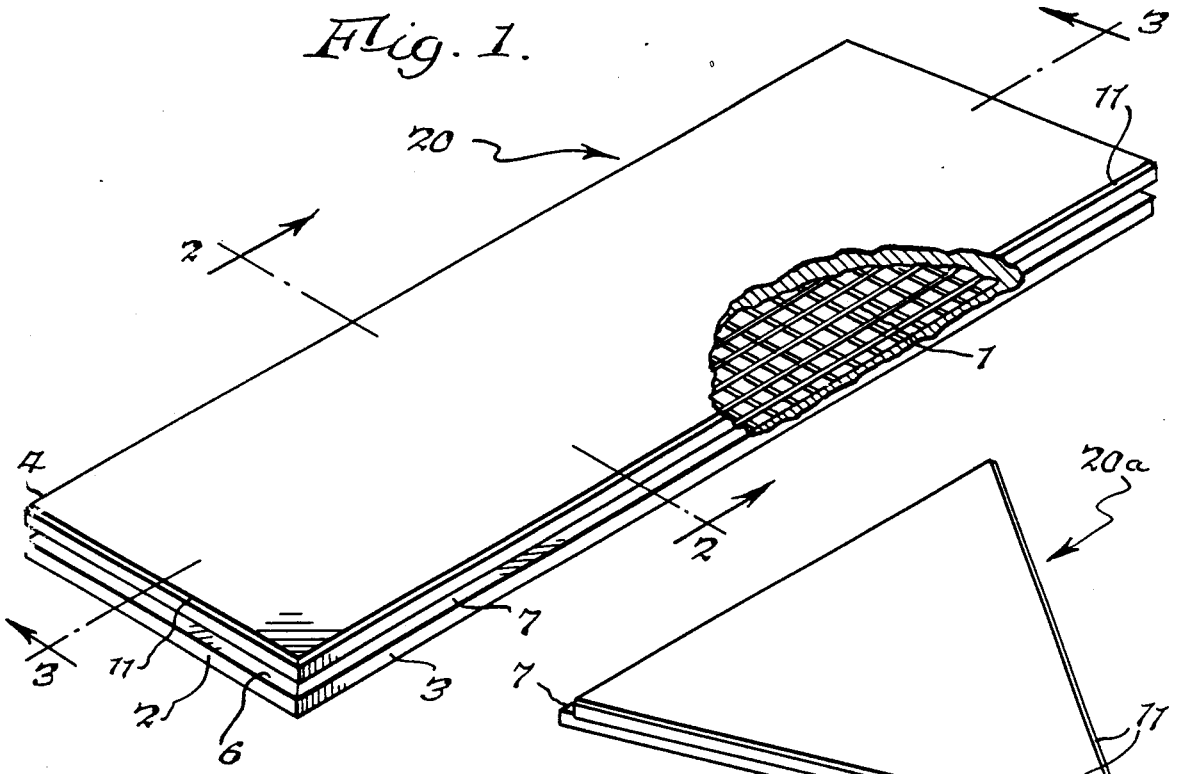
FIG. 1 is an elevation view, partly in cross section of a rectangular polygonal asphalt tile of the invention.

The polygonal tiles of the invention preferably comprise an asphalt type base binder, generally known as bitumen, and can contain a wide variety of filler materials. The bitumen base binder can be any of the variety of distillation products and by-products normally considered useful for pavement binders and include straight run bitumen, cut back bitumen and rubberized bitumen. The bitumen can be naturally occurring such as natural lake asphalt material which is a bitumen product normally containing finely divided mineral matter. In many instances however it is appropriate to reduce the viscosity of natural asphalt material by the addition of distilled bitumens. The bitumen base binder can comprise recycled pavement products, or can comprise waste bitumen products and the like.

The bitumen binder typically contains added fillers, usually comprising finely divided materials such as gravel, sand and the like. Colored pigments, stones and the like may be added to create ornamental effects. Recycled ground tire pieces and the like may be added to create greater wear resistance. Tiles may comprise varying layers of materials, such as top ornamental layers comprising abrasion resistant and/or colored gravels and the like.

The reinforcing means comprises a net like plastic gridwork imbedded in the asphalt at about the midpoint of its thickness. By plastic gridwork is meant any material which can be formed into a rigid or semi-rigid gridwork structure. Typically such plastic grid should be at least so rigid as to help the tile maintain its form during transporting and for ease of tile installation. Any suitable plastic material, which can be formed into a rigid or semi-rigid grid, can be used as a reinforcing means. Typically, the malleable metals such as aluminum, copper, the mild irons and the like make suitable grids. Preferred grids are typically comprised of the plastic organic polymer compounds such as the polymers of ethylene, polypropylene, polyester, polyamides, epoxy compounds.

The grid of the reinforcing means must be relatively dense, comprising defined open spaces not less than about one sixteenth square inches in area to not more than about one and one half square inches in area. It has been found that grids comprising less open space tend to need greater forming pressures when manufacturing the tiles to prevent premature delamination, while those with larger open spaces tend to be inadequate in maintaining the form of the bitumen material structure.

Referring now to the FIGURES, like reference numerals are meant to indicate like parts in the embodied paving tiles.

Figure 2:
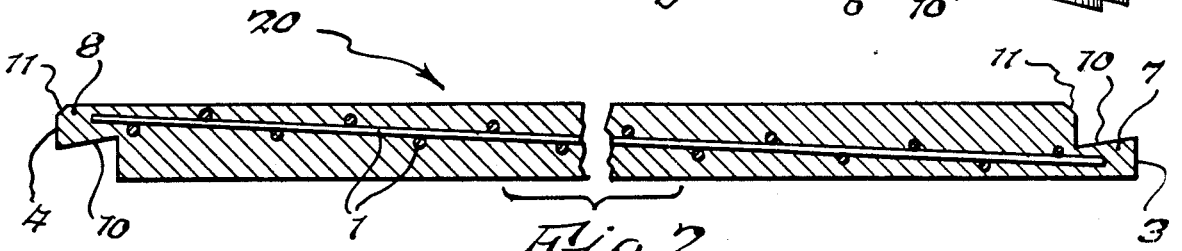
FIG. 2 is a sectional view, along line 2—2, of the rectangular asphalt tile of FIG. 1.
Figure 3:
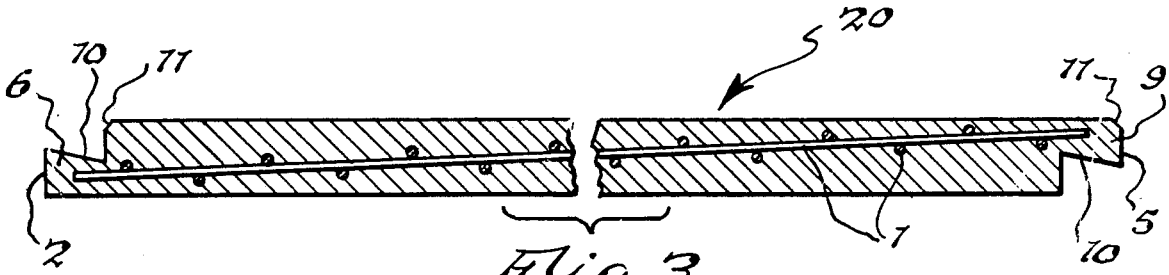
FIG. 3 is a sectional view, along line 3—3, of the rectangular asphalt tile of FIG. 1.

FIGS. 1, 2 and 3, embody a rectangular reinforced paving tile 20 comprising a net-like support structure 1 embedded within a bitumen composition containing rectangular structure having interlocking end extensions. End surfaces 2 and 3 of the tile, comprise the terminating surfaces of abutting lower surface interlocking extensions 6 and 7. The extensions are less than about one half the thickness of the paving tile, where they join the body of the tile, and extend outward from the tile a distance from about one to about six times the thickness of the paving tile. The extensions increase in thickness during their outward extension. End surfaces 4 and 5, comprise the terminating surfaces of abutting upper interlocking extensions 8 and 9, which also are less than approximately one half of the thickness of the paving tile at the body of the tile. These extensions also extend outward from the tile a distance from about one to about six times the thickness of the paving tile and also increase in thickness in their outward extension. In each instance of common polygonal tiles, the combined thickness of the lower surface interlocking extensions and the upper surface interlocking extensions, at any common point of the distance of their extension outward from the body of the tile, should be about the same or less than the maximum thickness of the tile. Similarly, the outward extension of the lower surface interlocking extension from the body of the structure should be about the same or less than the outward extension from the body of the upper surface interlocking extensions.

Thus, interlocking extensions 6 or 7 are arranged to angularly interlock with interlocking extensions 8 or 9 of a polygonal structure, adhering through the weight of the tile itself initially and thereafter by the normal interflow of the bitumen material that occurs as the tiles weather. Typically, the weight of the tile itself combined with the normal temperature variations of a typical summer and coupled with the weight of the traffic that the paving is intended to support are sufficient to assure the adherence of the overlapping, interlocking tiles. It should be understood however that it is also contemplated that the arranged tiles can be further compressed such as by tamping, roller pressure means and the like and/or that they be heated to assure a contiguous fit through the interflow of the bitumen material.

Provision is specifically and preferably made for the application of adhesive material to each or any of the contacting surfaces of the interlocking extensions, designated in the FIGURES as surfaces 10. The application of such adhesives can assure a contiguous fit when the surface being paved is especially rough or uneven. The upper surface of the paving tile of the figures can be beveled 11 at the edges to provide a decorative effect.

Figure 4:
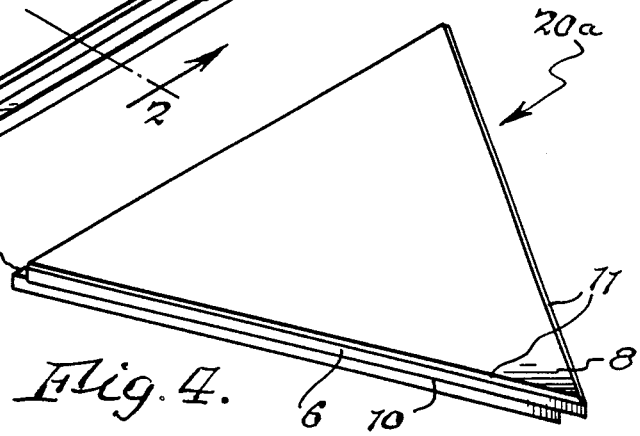
FIG. 4 is an elevation view of triangular polygonal asphalt tile of the invention.

In an embodiment of a polygonal tile comprising a three sided or other uneven number sided form, it is typically desirable that the tile be manufactured such that both the upper surface and the lower surface are decoratively interchangeable. FIG. 4, represents a three sided equilateral embodiment **20*a* comprising two lower surface interlocking extensions 6 and 7 and an upper surface interlocking extension 8. As is apparent, any interlocking combination of contacting surfaces 10** is easily attained by selecting the appropriate surface interlocking extension from a like tile.

I claim:

1. A portable, prefabricated, reinforced bitumen composition paving tile, comprising a polygonal body having a top surface, a bottom surface and at least three side surfaces, said polygonal body being formed from a bitumen containing composition and being of a thickness of from about one-half inch to about two and one-half inches, having angularly embedded through about the middle of the thickness thereof and along its length and breadth a support structure, and having extending from each side surface of the polygon body at least one of a continuous upper surface or lower surface interlocking extension, each said extension extending outwardly from the polygonal body of the paving tile a distance about one to about six times the thickness of the paving tile, each said extension having a thickness less than about the thickness of the paving tile at the body of the tile, the thickness of each said extension increasing as its extends outwardly from said polygonal body and said support structure being embedded in each said extension.

2. The paving tile of claim 1 wherein the upper and lower surfaces are decoratively interchangeable.

3. The paving tile of claim 2 wherein said polygon comprises three or more odd number of sides.

4. The paving tile of claim 1 wherein said polygon comprises four or more even number of side surfaces.

5. The paving tile of claim 4 wherein the polygon is a rectangle.

6. The paving tile of claim 5 wherein the polygon comprises two upper surface interlocking extensions and two lower surface interlocking extensions.

7. The paving tile of claim 6 wherein said upper extensions adjoin each other.

8. The paving tile of claim 6 wherein a coloring material has been added to the bitumen composition.

9. The paving tile of claim 6 wherein at least one of the top or bottom surfaces has a beveled edge.

10. The paving tile of claim 3 comprising three sides.

11. The paving tile of claim 10 wherein the top and bottom surfaces are decoratively interchangeable.

12. The paving tile of claim 1 having an adhesive material applied to at least one surface of an interlocking extension.

13. A paved surface comprising a paving tile of claim 1.

14. A paved surface of claim 13 having an adhesive material applied to at least one surface of an interlocking extension.

15. A paved surface of claim 13 wherein at least one of the top or bottom surfaces of a paving tile has a beveled edge.

* * * * *